US005399234A

United States Patent [19]

Yu et al.

[11] Patent Number: 5,399,234

[45] Date of Patent: Mar. 21, 1995

[54] ACOUSTICALLY REGULATED POLISHING PROCESS

[75] Inventors: Chris C. Yu; Tat-Kwan Yu; Jeffrey L. Klein, all of Austin, Tex.

[73] Assignee: Motorola Inc., Schaumburg, Ill.

[21] Appl. No.: 143,020

[22] Filed: Sep. 29, 1993

[51] Int. Cl.[6] ..... H01L 21/00

[52] U.S. Cl. ..... 156/636; 156/626; 156/627; 156/345; 437/225

[58] Field of Search ..... 156/645, 636, 626, 627, 156/345; 437/225

[56] References Cited

U.S. PATENT DOCUMENTS 5,240,552 8/1993 Yu et al. ..... 156/636

FOREIGN PATENT DOCUMENTS 61-071950 4/1986 Japan .
63-185556 8/1988 Japan .
02-009560 1/1990 Japan .
04-135173 5/1992 Japan .

*Primary Examiner*—R. Bruce Breneman
*Assistant Examiner*—George Goudreau
*Attorney, Agent, or Firm*—Jasper W. Dockrey

[57] ABSTRACT

A chemical-mechanical-polishing process in which acoustic waves are generated in the polishing slurry (18) to enable detection of an end-point in the polishing process, and to continuously clean the surface of a polishing pad (14) in a polishing apparatus (10). Acoustic waves are generated in the polishing slurry (18) by submerging a transducer (28) in the polishing slurry (18). The transducer (28) is powered by a voltage amplifier (30) coupled to a frequency generator (32). The frequency of the acoustic waves is adjusted by the frequency generator (32) to obtain optimum wave generation in the polishing slurry (18). The end-point of the polishing process is detected by a change in the acoustic wave velocity in the polishing slurry (18), which occurs when the slurry composition changes at end-point. The wave velocity is monitored by a receiver (34) submerged in the polishing slurry (18) at a predetermined distance from the transducer (28). Additionally, the acoustic wave frequency can be adjusted by the frequency generator (32) to induce sonic vibration in the polishing pad (14) such that continuous cleaning action is attained on the surface of the polishing pad (14).

5 Claims, 1 Drawing Sheet

ACOUSTICALLY REGULATED POLISHING PROCESS

FIELD OF THE INVENTION

This invention relates in general to a method for fabricating a semiconductor device, and more particularly, to a method for polish planarizing a material layer in a semiconductor device using a chemical-mechanical-polishing apparatus.

BACKGROUND OF THE INVENTION

The increasing need to form planar surfaces in semiconductor device fabrication has led to the development of process technology known as chemical-mechanical-polishing (CMP). In the CMP process, semiconductor substrates are rotated against a polishing pad in the presence of an abrasive slurry. Most commonly, the layer to be planarized is an electrically insulating layer overlying active circuit devices. As the substrate is rotated against the polishing pad, the abrasive force grinds away the surface of the insulating layer. Additionally, chemical compounds within the slurry undergo a chemical reaction with the components of the insulating layer to enhance the rate of removal. By carefully selecting the chemical components of the slurry, the polishing process can be made more selective to one type of material than another. For example, in the presence of potassium hydroxide, silicon dioxide is removed at a faster rate than boron nitride. The ability to control the selectivity of a CMP process has led to its increased use in the fabrication of complex integrated circuits.

A common requirement of all CMP processes is that the substrate be uniformly polished. In the case of polishing a electrically insulating layer, it is desirable to polish the layer uniformly from edge to edge on the substrate. To ensure that a planar surface is obtained, the electrically insulating layer must be uniformly removed. Uniform polishing can be difficult because, typically, there is a strong dependence of the polish removal rate on localized variations in the surface topography of the substrate. For example, in substrate areas having a high degree of surface variation, such as areas having closely spaced active devices, the polishing rate is higher than in areas lacking a high degree of surface contrast. Additionally, the polishing rate at the center of substrate may differ from the polishing rate at the edge of the substrate.

To compensate for the varying removal rates at different locations on the substrate surface, the polishing process is extended to ensure that a planar surface is obtained. A hard, thin-film, referred to as a polish-stop layer, can be used to prevent the unwanted removal of material in the underlying device layers during extended polishing. If the polish-stop material is sufficiently resistant to abrasive removal, and the polishing slurry is selective to the polish-stop material, the polishing time can be extended until the passivation layer is uniformly polished, without damaging underlying layers. To be selective to the polish-stop layer, the chemical components in the slurry must be substantially unreactive with the polish-stop material. Common polish-stop materials include silicon nitride and boron nitride, and the like. In the absence of a polish-stop layer, over-polishing can occur resulting in unwanted removal of underlying layers.

To ensure that uniform polishing action is obtained, it is important that the rate of material removal remain constant. Changes in the surface texture of the polishing pad during the polishing process reduce the degree of abrasiveness of the polishing pad. In particular, during the polishing of an insulating material, such as silicon dioxide, reaction products generated in the polishing slurry, and other debris, collect on the surface of the polishing pad. The collected material fills micro-pores in the surface of the polishing pad, which is known as glazing. When the micro-pores become filled with residue from the polishing process, the polishing rate declines. In extreme cases, a decline in polish removal rate can result in an incomplete removal of material leading to a degradation in polishing uniformity. This is because the polishing process is controlled by specifying a time interval for completion of the polishing process. The time interval is calculated based upon a specific and constant polish removal rate.

In order to avoid degradation in the polish removal rate caused by glazing the surface of the polishing pad, the pad is abraded by a conditioner, such as a steel brush. In the abrasion process, material is removed from the surface of the pad by a mechanical grinding process. This process results in removing material from the pad itself in addition to reaction products and debris from the polishing process. Changes in the surface structure of the polishing pad can result in process instability and reduced usable lifetime of the polishing pad.

While CMP potentially offers wide versatility, and the ability to form surfaces with a high degree of planarity, the polishing process must be carefully controlled to maintain optimum process performance. To date, methods to improve processing performance have included the development of high selectivity polishing slurries, and the development of various materials for use as polish-stop layers. However, further development is necessary to provide process parameter stability, and to provide real-time process control for the polishing apparatus.

SUMMARY OF THE INVENTION

In practicing the present invention there is provided a process for fabricating a semiconductor device in which a planarized layer is formed by an acoustically regulated polishing process. A polishing apparatus is provided, which includes a polishing pad submerged in a polishing slurry. A semiconductor substrate having a surface to be polished is submerged in the polishing slurry. Acoustic waves are generated in the polishing slurry, and the substrate surface is polished by the polishing pad. In one embodiment, the acoustic waves are monitored as the chemical composition of the slurry changes during the polishing process. A change in the velocity of the acoustic waves corresponds with a change in chemical composition indicating that a polishing end-point has been reached. In another embodiment, the acoustic waves are used to clean the surface of the polishing pad during the polishing process.

Figure 1:
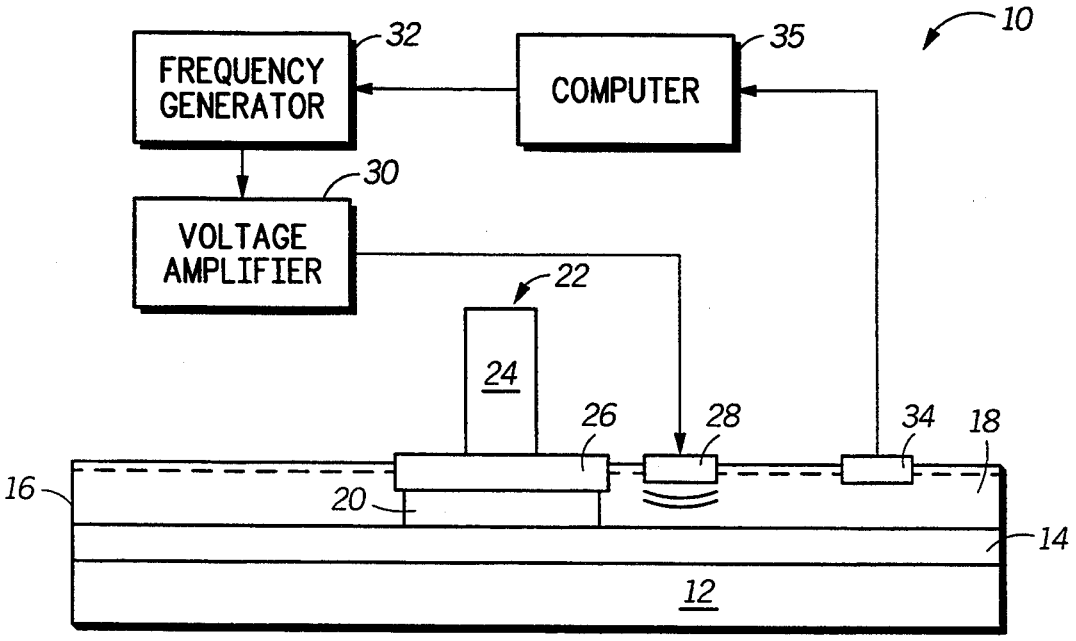
FIG. 1 is a schematic diagram of a polishing apparatus arranged in accordance with the invention.

It will be appreciated that for simplicity and clarity of illustration, elements shown in the FIGURES have not necessarily been drawn to scale. For example, the dimensions of some of the elements are exaggerated relative to each other for clarity. Further, where considered appropriate, reference numerals have been repeated among the FIGURES to indicate corresponding elements.

DETAILED DESCRIPTION OF PREFERRED EMBODIMENTS

The present invention provides an improved polishing process in which acoustic waves are generated within a polishing slurry, while polishing the surface of a semiconductor substrate. By generating acoustic waves in the polishing slurry, the chemical composition of the slurry can be monitored during the polishing process. This is possible because the speed of sound is a function of the physical and chemical characteristics of the propagation medium. Information about the slurry composition, collected during the process of polishing a semiconductor substrate, can be used to monitor the progress of material removal from the surface of the semiconductor substrate. Additionally, generation of acoustic waves in the slurry can also provide a means of cleaning the surface of a polishing pad simultaneous with the polishing process. The acoustic waves provide a constant agitation in the slurry, which prevents the clogging of micropores in the polishing pad by polishing debris suspended in the slurry. Accordingly, the introduction of acoustic waves in the polishing slurry provides an improved polishing process by enabling the determination of an end-point, and by improving the efficiency of the polishing process.

Shown in FIG. 1 is a schematic diagram of a polishing apparatus 10 arranged in accordance with the invention. Polishing apparatus 10 includes a polishing platen 12 which supports a polishing pad 14. Both polishing platen 12 and polishing pad 14 reside are bounded by a slurry retaining wall 16. Polishing pad 14 is submerged in a polishing slurry 18, which is confined to the area of the pad by retaining wall 16. A semiconductor substrate 20, which is to be planarized, is held against polishing pad 14 by a substrate carrier 22. Substrate carrier 22 includes a movable support arm 24 for bringing substrate 20 into contact with polishing pad 14, and a substrate support 26. Substrate support 26 includes an elastomeric pad (not shown) for holding substrate 20. Those skilled in the art will recognize the previously described features as those of a conventional polishing tool.

In operation, substrate 20 is polished by an abrasive action created by the rotational action of polishing pad 14 and substrate 20. Polishing slurry 18 is a colloidal composition containing an abrasive, such as silica particles, suspended in a solution of potassium hydroxide (KOH) and water. Additional chemicals are sometimes added to the slurry to adjust the pH, and to aid in suspending abrasives. During polishing, polishing slurry 18 serves to lubricate the surface of polishing pad 14, and to create an abrasive action at the surface of substrate 20. In addition, the chemicals in the slurry undergo a chemical reaction at the substrate surface, which assists in removing layers of material from the substrate.

In the process of the present invention, a transducer 28 is submerged in polishing slurry 18. Transducer 28 is powered by a voltage amplifier 30, which amplifies and AC electrical voltage signal from a computer controlled frequency generator 32. Voltage amplifier 30 is capable of providing 100–500 Watts of AC power to transducer 28. Frequency generator 32 is capable of modulating the electrical voltage signal at transducer 28 in the range of 100 Hz to 1 MHz. When power is applied to transducer 28, acoustic waves are induced in polishing slurry 18. Transducer 28 can be a piezoelectric material such as metallized quartz, or a metallized titanate material, such as lead zirconium titanate, and the like. Transducer 28 is submerged in polishing slurry 18 to enhance the coupling efficiency of the acoustic waves at the transducer to the slurry. The acoustic waves permeate throughout polishing slurry 18 and have an amplitude proportional to the power applied to transducer 28. The velocity of the acoustic waves generated in polishing slurry 18 by transducer 28 are proportional to the density of the polishing slurry. As the chemical composition of the slurry changes during polishing, the density of the polishing slurry changes in proportion to the changing chemical composition.

The concomitant change in acoustic wave velocity with slurry composition can be monitored by placing a receiver 34 in polishing slurry 18 and at a predetermined distance from transducer 28. The acoustic waves impinging on receiver 34 are converted to an electrical signal and transmitted to a computer 35. Computer 35 receives electrical signals from receiver 34 and determines the amount of change in acoustic velocity detected during the polishing operation. Computer 35 is also used to select and optimize the particular output frequency of transducer 28. The optimum frequency will vary depending upon the particular chemical composition of polishing slurry 18, and the particular chemical characteristics of the material layer being removed from semiconductor substrate 20.

Figure 2:
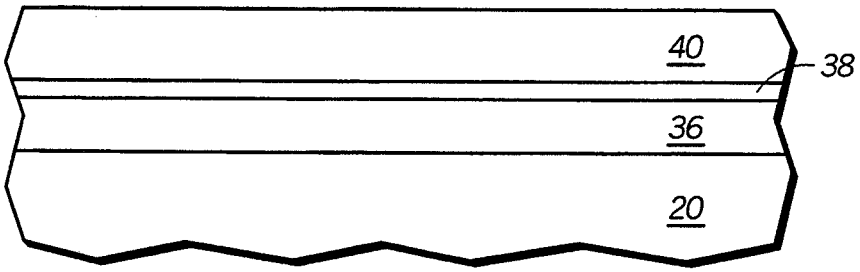
FIG. 2 illustrates, in cross-section, a portion of a semiconductor substrate having a material layer to be polished.

Shown in FIG. 2, in cross-section, is a portion of semiconductor substrate 20 supporting representative material layers commonly used to fabricate semiconductor devices, such as integrated circuits, and the like. In the exemplary structure, an active device layer 36 overlies semiconductor substrate 20. Active device layer 36 contains various components commonly present in a semiconductor device, such as transistors, resistors, capacitors, and the like. The components are fabricated in active regions which are electrically isolated by field isolation regions. Typically, the components are comprised of patterned layers of semiconductor and refractory metal materials. The components are covered by an insulating material to electrically isolate the components from overlying layers of conductive material. Contact openings are present in the insulating layer to permit electrical contact by overlying interconnect leads. The interconnect leads are typically fabricated in one or more overlying metal interconnect layers.

A metal interconnect layer 38 is shown in FIG. 2 overlying active device layer 36. Metal interconnect layer 38 is covered by an insulation layer 40. Although the exact material compositions can vary, in many integrated circuits layer 40 is an insulating material, such as silicon dioxide, silicon nitride, silicate glass, and the like. Metal interconnect layer 38 is typically an electrically conductive metal, such as aluminum alloyed with silicon, or aluminum alloyed with silicon and copper. Alternatively, interconnect layer 38 can be a refractory metal such as tungsten, titanium tungsten, and other refractory metal alloys.

In the case where insulation layer 40 is silicon dioxide, a chemical reaction occurs between the silicon dioxide in insulating layer 40 and the potassium hydroxide in polishing slurry 18 during the polishing of insulating layer 40. Although the exact reaction mechanism is unknown, it is believed that the primary reaction product is silanol ($Si(OH)_4$). As the reaction proceeds the concentration of silanol in polishing slurry 14 steadily increases. During this time, computer 35 monitors the changes in acoustic wave velocity and compensates by adjusting the signal frequency from frequency generator 32. Once portions of either a polish stop layer or metal interconnect layer 38 are uncovered by the polishing process, the concentration of silanol rapidly decreases. The decrease in silanol concentration causes a change acoustic wave velocity through the polishing slurry. This change is detected by computer 35 and analyzed by the processing control program running in computer 35. The polishing process is terminated when the incoming signal characteristics detected by computer 35 match predetermined control limits stored in computer 35.

During the polishing of a metal, the speed of the acoustic waves changes as the concentration of metal reaction products increases in the slurry. The concentration of metal reaction products steadily increases as the metal is polished. Upon exposure of an underlying insulating layer, the concentration of metal reaction products in the slurry rapidly decreases. The change is detected by receiver 34, which relays an electrical signal to computer 35. A processing program running in computer 35 analyzes the incoming electrical signal from receiver 34 to determine the extent of completion of the polishing process.

Figure 3:
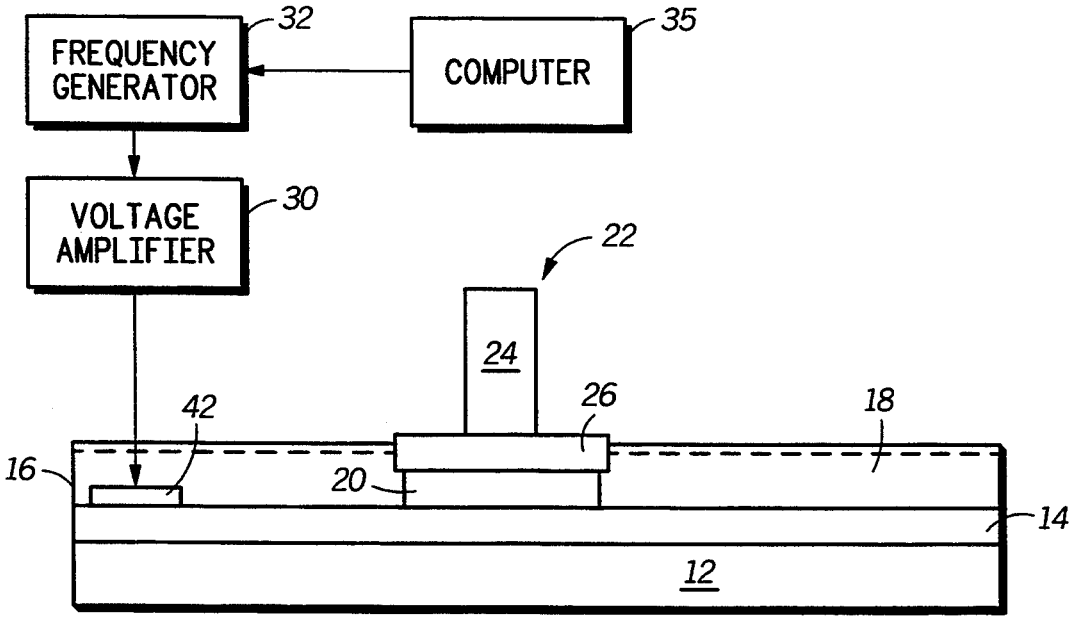
FIG. 3 is a schematic diagram of a polishing apparatus arranged in accordance with another embodiment of the invention.

Another embodiment of the invention is illustrated in the schematic diagram shown in FIG. 3. In this embodiment, voltage amplifier 30 powers a piezoelectric transducer 42, which is in contact with polishing pad 14. In operation, an ultrasonic wave is transmitted to polishing pad 14 from transducer 42 at a frequency ranging from about 100 Hz to 1 MHz. The acoustic waves impart vibrational energy to polishing pad 14. The vibration continuously breaks up solid residue on the surface of polishing pad 14, thereby improving the efficiency of the polishing process. The abrasiveness of polishing pad 14 is maintained at a high level by continuously removing reaction products and polishing debris from the surface of polishing pad 14. Additionally, by continuously cleaning the surface of pad 14, polishing apparatus 10 does not have to be shut down or otherwise interrupted for either a manual cleaning of the polishing pad, or for performing a process cleaning cycle. The continuous cleaning of the polishing pad results in longer periods of operation with shorter periods of down-time for cleaning maintenance. Thus, the continuous removal of material from the surface of polishing pad 14 results in maintaining a high polishing rate, and longer hours of continuous operation.

In order to optimize the acoustic energy transmitted to polishing pad 14, frequency generator 32 modulates the input signal to transducer 42 at the resonant frequency of polishing slurry 18 and polishing pad 14. For example, a sustained vibration can be induced in the polishing pad and the slurry by generating an acoustic wave having a frequency of preferably about 300 Hz at about 100 to 500 Watts. By transmitting acoustic waves at the resonant frequency of the slurry and the pad, maximum vibrational energy is achieved. Of course, the acoustic wave frequency must be varied depending upon the physical dimensions and composition of the polishing pad and the underlying platen. For example, in a polishing system having a platen diameter of one meter, the operational range of the transducer is preferably about 100 to 500 Hz.

The pad cleaning process can also be accomplished when transducer 42 is not in direct contact with polishing pad 14. In this case, transducer 42 is submerged in polishing slurry to the same extend as transducer 28, illustrated in FIG. 1. A resonant vibrational frequency is induced in polishing slurry 18, which dislodges material from the surface of polishing pad 14.

Thus it is apparent that there has been provided, in accordance with the invention, an acoustically regulated polishing process which fully meets the advantages set forth above. Although the invention has been described and illustrated with reference to specific illustrative embodiments thereof, it is not intended that the invention be limited to those illustrative embodiments. Those skilled in the art will recognize that variations and modifications can be made without departing from the spirit of the invention. For example, slurries having a wide variety of silica particle-size distributions can be used in the polishing apparatus. Furthermore, the temperature of the slurry can be controlled in the polishing apparatus. It is therefore intended to include within the invention all such variations and modifications as fall within the scope of the appended claims and equivalents thereof.

We claim:

1. A process for fabricating a semiconductor device comprising the steps of:

providing a polishing apparatus having a polishing pad submerged in a polishing slurry;

submerging a semiconductor substrate in the polishing slurry, the substrate having a surface;

generating acoustic waves in the slurry by means of an acoustic transducer submerged in the slurry;

polishing the substrate surface with the polishing pad; and determining the chemical composition of the slurry by monitoring the acoustic waves in the slurry using a receiver submerged in the slurry and spaced a predetermined distance from the transducer.

2. A process for fabricating a semiconductor device comprising the steps of:

providing a polishing apparatus having a polishing pad submerged in a polishing slurry;

submerging a semiconductor substrate in the polishing slurry, the substrate having a surface;

polishing the substrate surface with the polishing pad to remove material from the surface of the semiconductor substrate;

generating acoustic waves in the slurry; and modulating the acoustic waves at the resonant frequency of the slurry and the polishing pad wherein the acoustic waves continuously clean the removed material from the polishing pad.

3. The process of claim 2, wherein the step of generating acoustic waves comprises submerging an acoustic transducer in the slurry and applying electrical power to the transducer.

4. The process of claim 2, wherein the step of generating acoustic waves comprises placing an acoustic transducer in contact with the polishing pad and inducing acoustic vibration within the polishing pad.

5. A process for fabricating a semiconductor device comprising the steps of:

providing a polishing slurry for the removal of a material layer from a semiconductor substrate;

submerging the semiconductor substrate in the polishing slurry, the substrate having a surface;

generating an acoustic wave in the slurry; and monitoring the wave velocity through the slurry by means of a receiver submerged in the slurry and spaced a predetermined distance from an acoustic transducer to determine a change in the material composition of the surface of the substrate, while polishing the surface.

* * * * *